US010095162B2

(12) United States Patent
Katahira et al.

(10) Patent No.: US 10,095,162 B2
(45) Date of Patent: Oct. 9, 2018

(54) CLEANER AND IMAGE FORMING APPARATUS

(71) Applicant: FUJI XEROX CO., LTD., Tokyo (JP)

(72) Inventors: Masahiro Katahira, Kanagawa (JP); Yoshinori Takahashi, Kanagawa (JP); Yuki Nagamori, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/490,086

(22) Filed: Apr. 18, 2017

(65) Prior Publication Data

US 2018/0046113 A1 Feb. 15, 2018

(30) Foreign Application Priority Data

Aug. 9, 2016 (JP) ..... 2016-156814

(51) Int. Cl.
*G03G 15/16* (2006.01)

(52) U.S. Cl.
CPC ..... *G03G 15/161* (2013.01)

(58) Field of Classification Search
USPC ..... 399/91, 98, 99, 101, 123
See application file for complete search history.

(56) References Cited

U.S. PATENT DOCUMENTS 5,870,650 A * 2/1999 Takahashi ..... G03G 15/168 399/101
7,127,201 B2 * 10/2006 Takenouchi ..... G03G 15/0131 399/101
2014/0270839 A1 9/2014 Matsumoto et al.

FOREIGN PATENT DOCUMENTS

JP 2012-203427 A 10/2012
JP 2014-182172 A 9/2014

* cited by examiner

*Primary Examiner* — Hoan Tran
(74) *Attorney, Agent, or Firm* — Sughrue Mion, PLLC

(57) ABSTRACT

A cleaner includes first and second cleaning plates. The first cleaning plate includes a first free end and performs cleaning by causing the first free end to be in contact with an outer circumferential surface of a cylindrical second transfer rotating body including an elastic layer, so that the outer circumferential surface is elastically deformed. The second cleaning plate includes a second free end and performs cleaning by causing the second free end to be in contact with a portion of the outer circumferential surface downstream of, in a rotational direction of the second transfer rotating body, a position where the first free end is in contact with the outer circumferential surface and where the outer circumferential surface is elastically deformed due to the contact of the outer circumferential surface with the first free end so as to have a smallest surface curvature in the outer circumferential surface.

8 Claims, 12 Drawing Sheets

FIG. 9

| | CONDITIONS OF SECOND CLEANING PLATE | | RESULT OF TESTING | |
|---|---|---|---|---|
| | CONTACT POSITION (mm) | PRESSING DEPTH (mm) | FILM-SHAPED SUBSTANCE | SCRATCH |
| COMPARATIVE EXAMPLE | ABOUT 10 | 0.3 | PRODUCED | NOT SCRATCHED |
| | | 0.5 | PRODUCED | SLIGHTLY SCRATCHED |
| | | 0.7 | SLIGHTLY PRODUCED | SCRATCHED |
| EXAMPLE | ABOUT 1.5 | 0.3 | NOT PRODUCED | NOT SCRATCHED |
| | | 0.5 | NOT PRODUCED | NOT SCRATCHED |
| | | 0.7 | NOT PRODUCED | NOT SCRATCHED |

CLEANER AND IMAGE FORMING APPARATUS

CROSS-REFERENCE TO RELATED APPLICATIONS

This application is based on and claims priority under 35 USC 119 from Japanese Patent Application No. 2016-156814 filed Aug. 9, 2016.

BACKGROUND

Technical Field

The present invention relates to a cleaner and an image forming apparatus.

SUMMARY

According to an aspect of the present invention, a cleaner includes a first cleaning plate and a second cleaning plate. The first cleaning plate includes a first free end and performs cleaning by causing the first free end to be in contact with an outer circumferential surface of a cylindrical second transfer rotating body that includes an elastic layer, so that the outer circumferential surface is elastically deformed. The second cleaning plate includes a second free end and performs cleaning by causing the second free end to be in contact with a portion of the outer circumferential surface of the second transfer rotating body downstream of, in a rotational direction of the second transfer rotating body, a position where the first free end is in contact with the outer circumferential surface of the second transfer rotating body and where the outer circumferential surface of the second transfer rotating body is elastically deformed due to the contact of the outer circumferential surface of the second transfer rotating body with the first free end so as to have a smallest surface curvature in the outer circumferential surface of the second transfer rotating body.

BRIEF DESCRIPTION OF THE DRAWINGS

Exemplary embodiments of the present invention will be described in detail based on the following figures, wherein:

FIG. 9 is a table illustrating some of conditions of the testing and results of the testing;

FIG. 12A illustrates one of the other examples of the structure and FIG. 12B illustrates another of the other examples of the structure.

DETAILED DESCRIPTION

Exemplary embodiments of the present invention (referred to as "exemplary embodiments" hereafter) will be described below with reference to the drawings.

First Exemplary Embodiment

Figure 1:
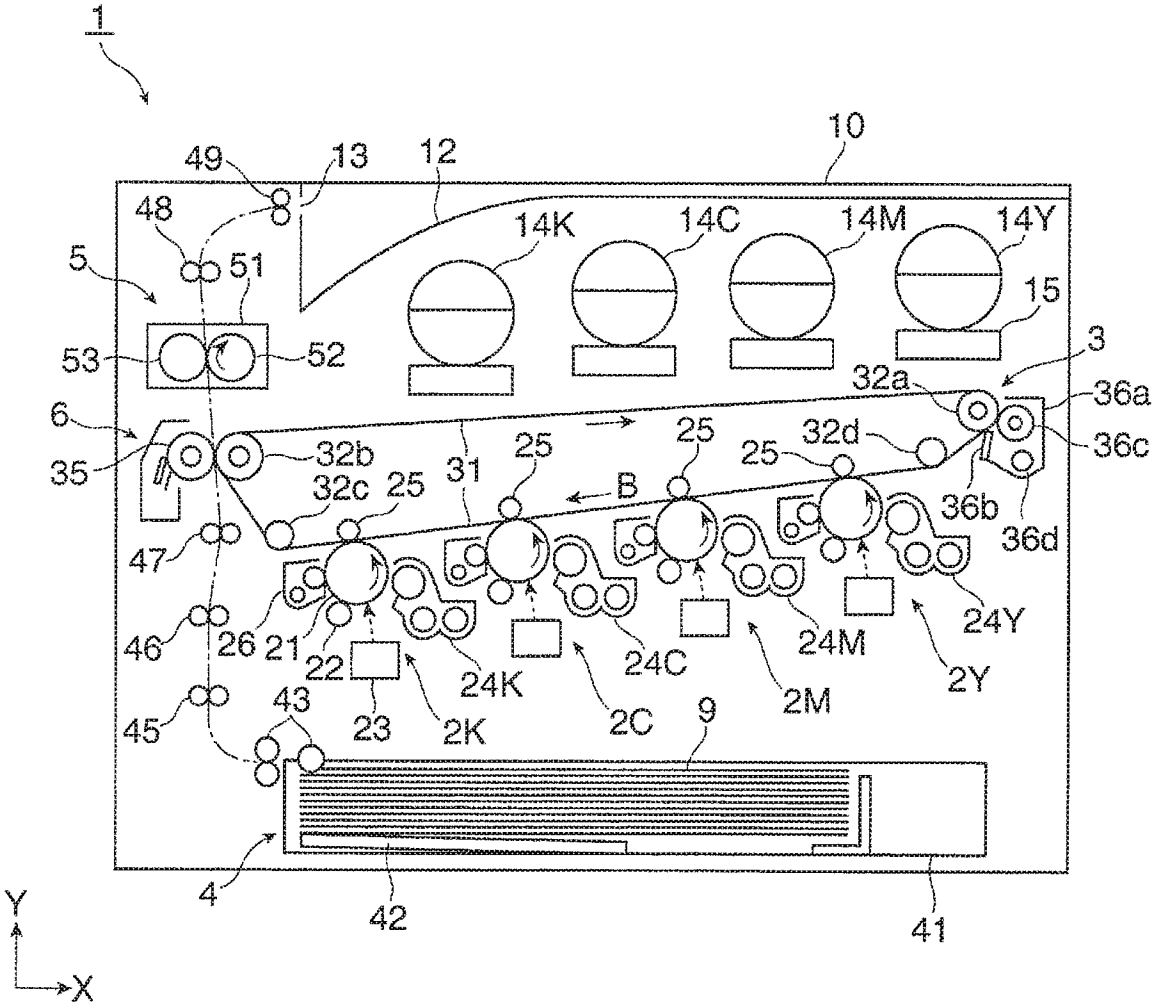
FIG. 1 conceptually illustrates the structure of an image forming apparatus according to a first exemplary embodiment.
Figure 2:
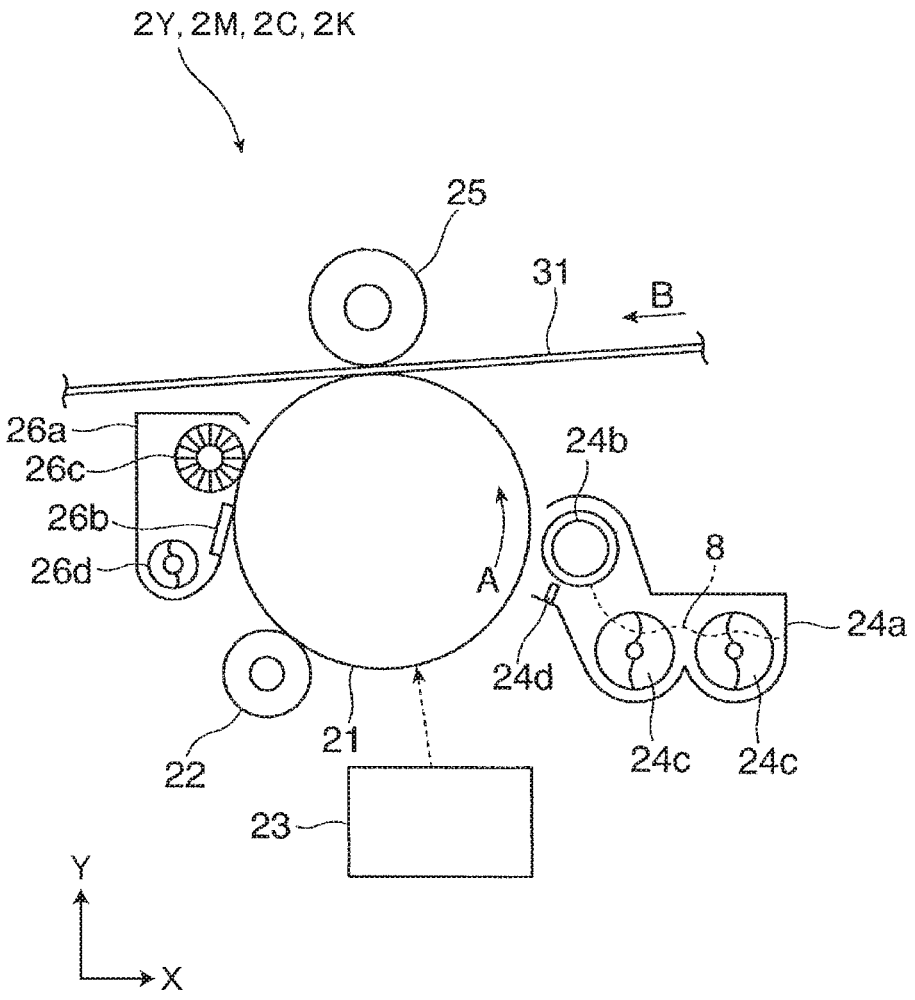
FIG. 2 conceptually illustrates the structure of parts (an image forming device and so forth) of the image forming apparatus illustrated in FIG. 1.
Figure 3:
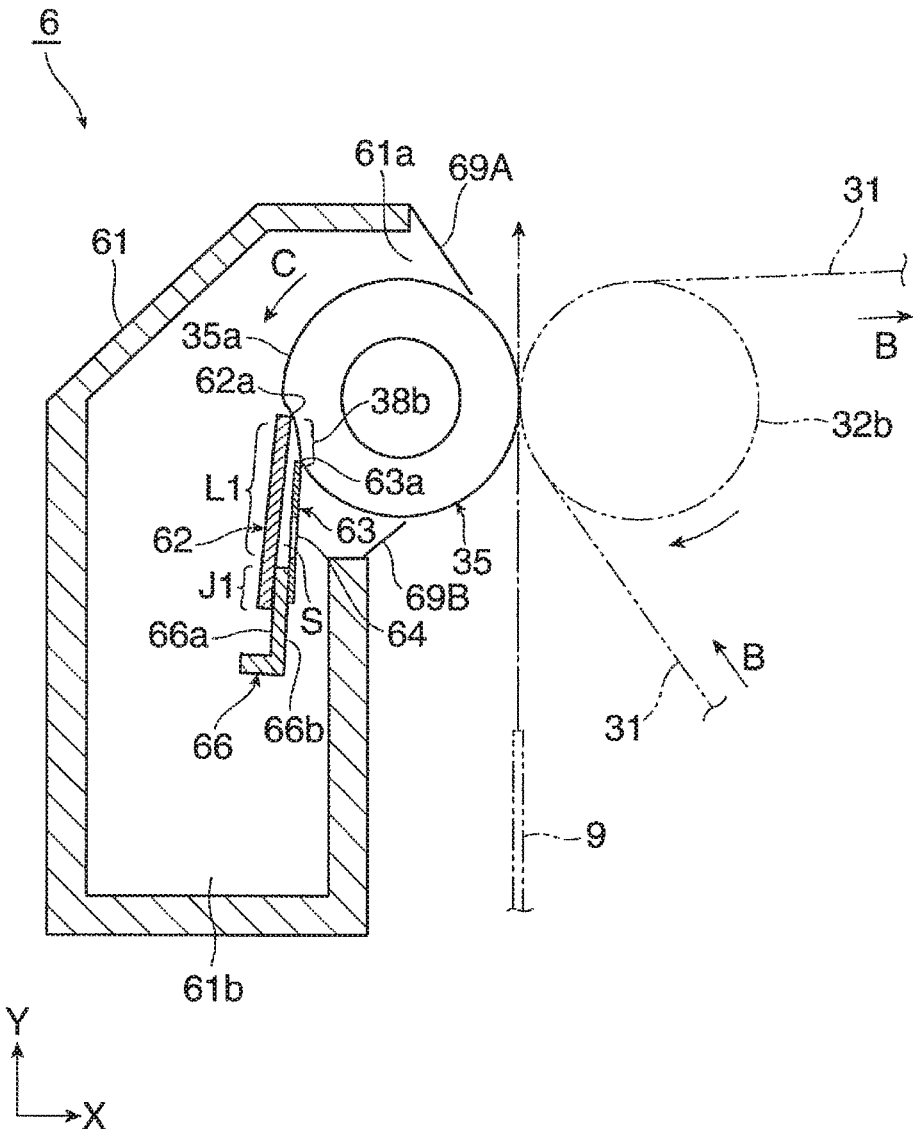
FIG. 3 is a partially sectional view conceptually illustrating the structure of a cleaner according to the first exemplary embodiment used for the image forming apparatus illustrated in FIG. 1.

FIGS. 1 to 3 illustrate a cleaner and an image forming apparatus according to a first exemplary embodiment. Specifically, FIG. 1 illustrates the structure of the image forming apparatus, FIG. 2 illustrates the structure of parts (an image forming device and so forth) of the the image forming apparatus, and FIG. 3 illustrates the structure of the cleaner and parts around the cleaner. Arrows in, for example, FIG. 1 denoted by signs X, Y, and Z are (directions of) axes of rectangular coordinates indicating the width, height, and depth directions of a three-dimensional space assumed in each of the drawings.

The Structure of the Image Forming Apparatus

An image forming apparatus 1 according to the first exemplary embodiment forms images made of developer on recording sheets 9 and is configured as, for example, a printer that forms images by receiving image information input from an external device such as an information terminal device. The recording sheets 9 each serve as an example of a recording medium. When also equipped with, for example, a document reader, this image forming apparatus 1 may be configured as a copier or a copier (multifunction machine) having a facsimile function.

The image forming apparatus 1 includes a housing 10 that has a generally box-shaped appearance and components such as the following components disposed in an inner space of the housing 10: image forming devices 2 that form toner images made of toner serving as developer; an intermediate transfer device 3 that holds, through first transfer, the toner images formed by the image forming devices 2 and, after that, transports the toner images to a second transfer position where the toner images are finally transferred onto the recording sheets 9 through second transfer; a sheet feed device 4 that contains and feeds the recording sheets 9 supplied to the second transfer position of the intermediate transfer device 3; and a fixing device 5 that fixes onto the recording sheets 9 the toner images having been transferred onto the recording sheets 9 through the second transfer by the intermediate transfer device 3. A support structure and exterior components of the housing 10 include a support member, an external covering, and so forth. Furthermore, an output sheet receiving unit 12 is formed in an upper surface portion of the housing 10. The recording sheets 9 onto which the images have been formed are output to and received in the output sheet receiving unit 12. A dot-dash line illustrated in FIG. 1 indicates a typical transport path for the recording sheets 9 in the housing 10.

The image forming devices 2 include four image forming devices 2Y, 2M, 2C, and 2K that independently form developer (toner) images of four colors, that is, yellow (Y), magenta (M), cyan (C), and black (K), respectively.

The four image forming devices 2Y, 2M, 2C, and 2K are, as illustrated in FIGS. 1 and 2, each include a photosensitive drum 21, a charger 22, a light exposure device 23, a developing device 24Y, 24M, 24C, or 24K, a first transfer device 25, a drum cleaner 26, and so forth. The photosensitive drum 21 is rotated. The charger 22 charges an image holding surface on an outer circumferential surface of the photosensitive drum 21 to a required potential. The light exposure device 23 radiates light (dotted arrow) separated into a color component (Y, M, C, or K) in accordance with the image information toward a charged image forming surface of the photosensitive drum 21 so as to form an electrostatic latent image of the color component. The developing device 24Y, 24M, 24C, or 24K supplies the toner of the color component to the electrostatic latent image to develop the electrostatic latent image, thereby visualizing the electrostatic latent image into a toner image of the color (Y, M, C, or K). The first transfer device 25 transfers through first transfer the toner image on the photosensitive drum 21 onto (an intermediate transfer belt 31 of) the intermediate transfer device 3. The drum cleaner 26 cleans the photosensitive drum 21 by removing undesired matter such as toner remaining on the outer circumferential surface of the photosensitive drum 21.

For example, a drum-shaped photosensitive body is used as the photosensitive drum 21. The photosensitive body includes, for example, a grounded barrel-shaped or cylindrical base material and the image holding surface that has a photodielectric layer (photosensitive layer) made of a photosensitive material and formed on an outer circumferential surface of the base material. This photosensitive drum 21 receives a motive force from a rotation drive device (not illustrated) so as to be rotated in an arrow A direction.

For example, a contact-type charger is used as the charger 22. The contact-type charger includes a contact member such as a charging roller which is disposed so as to be in contact with at least the image holding surface of the photosensitive drum 21 and to which a charging current is supplied.

For example, a non-scanning type light exposure device that includes light emitting diodes, optical components, and so forth is used as the light exposure device 23. Alternatively, the light exposure device 23 may be of a scanning type that includes, for example, a semiconductor laser and optical components including a polygon mirror. The image information received from the outside of the image forming apparatus 1 is subjected to required processes performed by an image processing device (not illustrated), and after that, input as an image signals to the light exposure device 23.

As illustrated in, for example, FIG. 2, each of the developing devices 24Y, 24M, 24C, and 24K includes a housing 24*a* that has a container chamber and a developing opening. The container chamber contains two-component developer 8 containing non-magnetic carrier and non-magnetic toner of a corresponding one of the color components (Y, M, C, and K). For example, components such as a developing roller 24*b*, transport members 24*c*, and a layer thickness regulating member 24*d* are disposed in the housing 24*a* of each of the developing devices 24Y, 24M, 24C, and 24K. The developing roller 24*b* holds the two-component developer 8 contained in the container chamber while being rotated so as to transport the two-component developer 8 so that the two-component developer 8 passes through a developing region that exists near the photosensitive drum 21 and faces the photosensitive drum 21 at the developing opening. The transport members 24*c* are, for example, screw augers that are rotated so as to transport the two-component developer 8 for supplying the two-component developer 8 to the developing roller 24*b* while agitating the two-component developer 8 contained in the container chamber of the housing 24*a*. The layer thickness regulating member 24*d* regulates the amount (layer thickness) of the developer held by the developing roller 24*b*.

In each of the developing devices 24Y, 24M, 24C, and 24K, the developing roller 24*b* and the transport members 24*c* are rotated in required directions, and a developing current or the like is supplied between the developing roller 24*b* and the photosensitive drum 21. Furthermore, as illustrated in FIG. 1, each of the developing devices 24Y, 24M, 24C, and 24K is replenished with a required amount of replenishment developer (toner or toner and carrier) from a corresponding one of developer cartridges 14Y, 14M, 14C, and 14K through a corresponding one of replenishment devices 15 and a connecting member (not illustrated). The developer cartridges 14Y, 14M, 14C, and 14K are detachable from the image forming apparatus 1 for replacement and contain the replenishment developer for the respective developing devices 24Y, 24M, 24C, and 24K.

For example, a contact-type transfer device is used as the first transfer device 25. The contact-type transfer device includes a contact member such as a first transfer roller which is in contact with a surface portion that serves as a first transfer position of the photosensitive drum 21 (with the intermediate transfer belt 31 interposed therebetween) to be rotated and to which a first transfer current is supplied. The first transfer device 25 may be considered as part of the intermediate transfer device 3.

The drum cleaner 26 includes, for example, a housing 26*a*, an elastic cleaning plate 26*b*, a rotating cleaning brush 26*c*, and a feed member 26*d*. The housing 26*a* has a cleaning opening. The elastic cleaning plate 26*b* and the rotating cleaning brush 26*c* are, through the cleaning opening, in contact with at least the image holding surface of the photosensitive drum 21 having passed through the first transfer position where the toner image is transferred through the first transfer to (the intermediate transfer belt 31 of) the intermediate transfer device 3. Through this contact, the elastic cleaning plate 26*b* and the rotating cleaning brush 26*c* clean the photosensitive drum 21 by removing undesired matter such as residual toner. The feed member 26*d* is a screw auger or the like that collects the removed matter such as the removed toner and feeds the collected removed matter to a collection container (not illustrated).

The intermediate transfer device 3 includes an intermediate transfer belt 31, plural support rollers 32*a* to 32*d*, a second transfer roller 35, and a belt cleaner 36. The intermediate transfer belt 31 passes through the first transfer positions of the photosensitive drums 21 of the image forming devices 2Y, 2M, 2C, and 2K while being rotated in an arrow B direction. The support rollers 32*a* to 32*d* hold the intermediate transfer belt 31 in a desired state from an inner circumferential surface of the intermediate transfer belt 31 while supporting the intermediate transfer belt 31 such that the intermediate transfer belt 31 is rotatable. The second transfer roller 35 serving as an example of a second transfer device is in contact at a required pressure with a portion of an outer circumferential surface of the intermediate transfer belt 31 supported by the support roller 32*b* so as to be rotated. The belt cleaner 36 cleans the intermediate transfer belt 31 by removing undesired matter such as toner and paper dust remaining on and adhering to a portion of the outer circumferential surface of the intermediate transfer belt 31 having passed through a contact portion (second transfer position) where the intermediate transfer belt 31 is in contact with the second transfer roller 35.

The intermediate transfer belt 31 is a belt that has an endless shape, has a required thickness and a required electrical resistance value, and is formed of a material made by dispersing a resistance adjuster such as carbon in a base material such as, for example, polyimide resin or polyamide resin. The plural support rollers 32*a* to 32*d* serve as follows: the support roller 32*a* serves as a drive roller and a tension applying roller that applies a rotational motive force and a tensile force to the intermediate transfer belt 31; the support roller 32*b* serves as a backup roller for the second transfer; and the support rollers 32*c* and 32*d* serve as surface forming rollers that form and hold a first transfer surface of the intermediate transfer belt 31.

Figure 5:
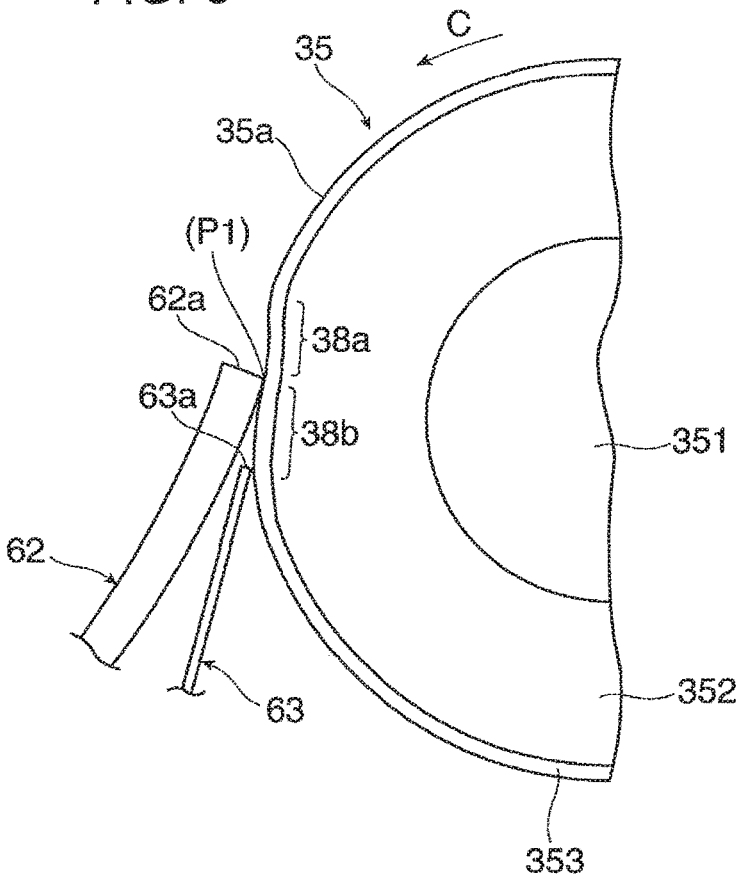
FIG. 5 is an enlarged view illustrating a structure relating to a contact state of the first cleaning plate and the second cleaning plate of the cleaner illustrated in FIG. 3.

As illustrated in, for example, FIG. 3, a cylindrical rotating body that includes at least an elastic layer is used as the second transfer roller 35. The second transfer roller 35 is rotatable in an arrow C direction. As illustrated in FIG. 5, the second transfer roller 35 according to the first exemplary embodiment is, for example, a rotating body in which an elastic layer 352 and a surface layer 353 are stacked in this order on an outer circumferential surface of an electrically conductive roller base body 351 formed of a material such as metal. The elastic layer 352 is formed of, for example, a material in which a conductant agent such as carbon black is mixed into an elastic material made of, for example, epichlorohydrin, urethane foam, acrylonitrile-butadiene rubber (NBR), styrene-butadiene rubber (SBR), or ethylene propylene diene monomer (EPDM). The surface layer 353 is formed of, for example, a synthetic resin such as polyimide resin, polyamide resin, polyamidoimide resin, polyetherester resin, polyarylate resin, or polyester resin. A second transfer current or the like is supplied to the second transfer roller 35 or the support roller 32*b*. The Asker C hardness representing part of the hardness of an outer circumferential surface of the second transfer roller 35 is set to 20 to 50 degrees, and preferably, set to 30 to 40 degrees.

Furthermore, the second transfer roller 35 is provided with a dedicated cleaner 6 that is in contact with the outer circumferential surface of the second transfer roller 35 so as to remove undesired matter such as toner, thereby cleaning the second transfer roller 35. The details of the cleaner 6 will be described later.

The belt cleaner 36 includes, for example, a housing 36*a*, a plate-shaped member 36*b*, a rotating brush 36*c*, and a feed member 36*d*. The housing 36*a* has a cleaning opening. The plate-shaped member 36*b* and the rotating brush 36*c* are, through the cleaning opening, in contact with at least an image holding surface of the intermediate transfer belt 31 having passed through the second transfer position. Through this contact, the plate-shaped member 36*b* and the rotating brush 36*c* remove undesired matter such as residual toner. The feed member 36*d* is a screw auger or the like that collects the removed matter such as the removed toner and feeds the collected removed matter to a collection container (not illustrated).

The sheet feed device 4 includes a container 41 and a feed device 43. The container 41 is attached such that the container 41 is able to be drawn from the housing 10. The container 41 contains the recording sheets 9 of a desired size, type, and so forth stacked on a placement plate 42. The feed device 43 feeds one sheet after another from the stack of recording sheets 9 in the container 41 toward the sheet transport path. The number of a container 41 is not limited to one. Plural containers 41 may be used.

The fixing device 5 includes, for example, a heating rotating body 52 and a pressure rotating body 53 in a housing 51 thereof. The heating rotating body 52 is in the form of, for example, a roller or a belt, rotated in a required direction, and heated by a heater, so that the surface temperature of the heating rotating body 52 is maintained at a required temperature. The pressure rotating body 53 is in the form of, for example, a roller or a belt and in contact with the heating rotating body 52 substantially in a rotational axis direction of the heating rotating body 52 at a required pressure so as to be rotated. In this fixing device 5, a region where the heating rotating body 52 and the pressure rotating body 53 are in contact with each other is a fixing process portion into which the recording sheets 9 holding the toner images are introduced so as to be subjected to a fixing process (pressure and heat).

As illustrated in FIG. 1, a sheet transport path is provided in the housing 10. Through the sheet transport path, each of the recording sheets 9 is typically transported from the feed device 43 of the sheet feed device 4 to an output opening 13 provided upstream of the output sheet receiving unit 12 in a sheet transport direction through the second transfer position of the intermediate transfer device 3 and the fixing process portion of the fixing device 5. Plural transport roller pairs 45 to 49, a transport guide (not illustrated), and so forth are provided along the sheet transport path. In particular, the transport roller pair 47 serves as a registration roller pair that has the functions of, for example, adjusting and correcting timing at which the recording sheet 9 is transported to the second transfer position and a transport orientation (skew) of the recording sheet 9. Furthermore, the transport roller pair 49 serves as output rollers that output the recording sheet 9 so as to feed the recording sheet 9 to the output sheet receiving unit 12.

Furthermore, the image forming apparatus 1 is able to form a multi-color image by operating all the image forming devices 2Y, 2M, 2C, and 2K or selecting and operating some (at least the image forming devices 2 for plural colors) of the image forming devices 2Y, 2M, 2C, and 2K so as to combine toner of all or some of plural colors of four colors (Y, M, C, and K). Alternatively, by operating one of the image forming devices 2Y, 2M, 2C, and 2K, the image forming apparatus 1 is able to form a monochrome image of toner of a single color such as, for example, black. Furthermore, the image forming apparatus 1 allows selection and execution of special image forming operations (modes). The special image forming operations (modes) refers to such operations in which, for example, an image having a size corresponding to the entirety of a single side of the recording sheet 9, that is, a borderless image is formed.

A Basic Image Forming Operation of the Image Forming Apparatus

With the image forming apparatus 1, a basic image forming operation is performed as follows. It is noted that an image forming operation of forming a so-called full-color image, that is, a multi-color image formed by combining toner images of four colors (Y, M, C, and K) is described herein.

Upon reception of a request instruction for an image forming operation (print), toner images are formed by four image forming devices 2Y, 2M, 2C, and 2K in the substantially identical manners.

First, in each of the image forming devices 2Y, 2M, 2C, and 2K, the photosensitive drum 21 is rotated in the arrow A direction, and the charger 22 charges the image holding surface of the photosensitive drum 21 to a required potential of a required polarity (for example, the minus polarity according to the first exemplary embodiment).

After this charging, the light exposure device 23 performs light exposure on (radiates light to) the charged image holding surface of the photosensitive drum 21 in accordance with an image signal of a corresponding color component out of the separated four color components (Y, M, C, and K). Thus, the electrostatic latent image of the corresponding separated color component is formed on the image holding surface of the photosensitive drum 21.

Next, each of the developing devices 24Y, M, C, and K causes the toner supplied from its developing roller 24*b* to electrostatically adhere to portions of the image holding surface of the photosensitive drum 21 corresponding to the electrostatic latent image for the corresponding one of the color components so as to develop the electrostatic latent image. Thus, the electrostatic latent image of the corresponding color on the photosensitive drum 21 is visualized as a toner image corresponding to the color component out of four colors (Y, M, C, and K).

Next, the toner image of the corresponding color formed on the photosensitive drum 21 of each of the image forming devices 2Y, 2M, 2C, and 2K is transferred onto the recording sheet 9 via the intermediate transfer device 3.

First, the toner image formed on the photosensitive drum 21 is transported to the first transfer position where the photosensitive drum 21 is in contact with the first transfer device 25 with the rotating intermediate transfer belt 31 interposed therebetween. After that, due to exposure of the toner image to transfer action (typically electrostatic action by a transfer electric field) of the first transfer device 25, the toner image is electrostatically transferred through the first transfer onto the intermediate transfer belt 31 at the first transfer position.

Next, the toner image having been transferred through the first transfer onto the intermediate transfer belt 31 is transported to the second transfer position due to the rotation of the intermediate transfer belt 31. After that, due to exposure of the toner image to transfer action (typically electrostatic action due to a transfer electric field) of the second transfer roller 35, the toner image is electrostatically transferred through the second transfer at the second transfer position onto the recording sheet 9 having fed from the sheet feed device 4 and transported at required timing through the sheet transport path. Through the second transfer, the toner images of four colors are collectively transferred onto the recording sheet 9.

At last, the toner images having been transferred onto the recording sheet 9 are fixed by the fixing device 5.

First, the recording sheet 9 having undergone the second transfer in the intermediate transfer device 3 is separated from the intermediate transfer belt 31 of the intermediate transfer device 3, and then transported to the fixing device 5. Next, the recording sheet 9 onto which the toner images have been transferred is introduced into the fixing process portion between the heating rotating body 52 and the pressure rotating body 53 in the fixing device 5, and accordingly, subjected to heat and pressure. Thus, the toner of the toner images are fused under the pressure, thereby being fixed onto the recording sheet 9.

In the case where image formation is performed only on a single side of the recording sheet 9, the recording sheet 9 having been undergone the fixing is transported to the output opening 13 of the housing 10 through the sheet transport path, and then output to and received in the output sheet receiving unit 12.

Through the image forming operation having been described, the full-color image in which the toner images of four colors are combined with one another is formed on a single side of a single recording sheet 9.

The Structure of the Cleaner for the Second Transfer Roller

In the image forming apparatus 1, film-shaped substances (film-shaped deposits) derived from an external additive of the toner may be sparsely formed on the outer circumferential surface of the second transfer roller 35. In the image forming apparatus 1, an increase in the amount of the film-shaped substances may lead to, for example, difficulty in forming a uniform transfer electric field at the second transfer position, and accordingly, cause second transfer defects. This may in turn induce image quality problems due to the second transfer defects.

It is observed that these film-shaped substances are produced even when a related-art cleaner that performs cleaning by causing a free end of a plate-shaped cleaning member (cleaning blade) formed of an elastic body to be in contact with the outer circumferential surface of the second transfer roller 35 is equipped.

Furthermore, these film-shaped substances are frequently produced particularly when the image forming operation for a borderless image is performed.

That is, a toner image for a borderless image is formed in a region that is slightly larger in size (planar dimension) than the recording sheet 9. Thus, when such a toner image is transferred through the second transfer from the intermediate transfer belt 31 onto the recording sheet 9, portions of the toner corresponding to portions of the toner image lying off from the leading and trailing edges and the left and right edges of the recording sheet 9 in the transport direction are transitioned and adhere to the outer circumferential surface side of the second transfer roller 35. In this case, the second transfer roller 35 needs to be cleaned by removing the toner adhering thereto. However, even when the above-described related-art cleaners are used for cleaning, the external additive such as silica or titania (particularly having an average particle size of tens to hundreds nm) externally added to the particle surfaces of the toner escapes being removed by the plate-shaped cleaning member instead of being removed by the cleaning member. Due to contact with the plate-shaped cleaning member thereafter, the escaped external additive is continuously pressed against the outer circumferential surface of the second transfer roller 35. As a result, the escaped external additive is, at last, caused to spread and remain on the outer circumferential surface as film-shaped substances adhering to the outer circumferential surface in the form of, for example, thin films.

In order to address this, with the image forming apparatus 1, the cleaner 6 having the following structure is used as a cleaner that cleans the outer circumferential surface of the second transfer roller 35.

As illustrated in, for example, FIG. 3, this cleaner 6 at least includes in a container-shaped housing 61 having a cleaning opening 61*a* a first cleaning plate 62 and a second cleaning plate 63. In, for example, FIG. 3, reference numeral

66 denotes a support member that supports the first cleaning plate 62 and the second cleaning plate 63, and reference numerals 69A and 69B denote film-shaped anti-leakage members (so-called seal members) that prevent undesired matter such as toner having been removed and collected in the housing 61 leaking through a gap between the edges of of the housing 61 around the cleaning opening 61*a* and the second transfer roller 35.

The housing 61 functions as a collection container in which undesired matter such as toner removed by the first cleaning plate 62 and the second cleaning plate 63 is collected. The housing 61 according to the first exemplary embodiment generally has a box shape elongated in a rotational axis direction D of the second transfer roller 35. The cleaning opening 61*a* is provided on one side in an upper portion of the housing 61, has a rectangular shape, and faces the outer circumferential surface of the second transfer roller 35. A collection space 61*b* is formed on a lower portion side of the housing 61 having a volume necessary for collecting the removed undesired matter such as toner.

Figure 6:
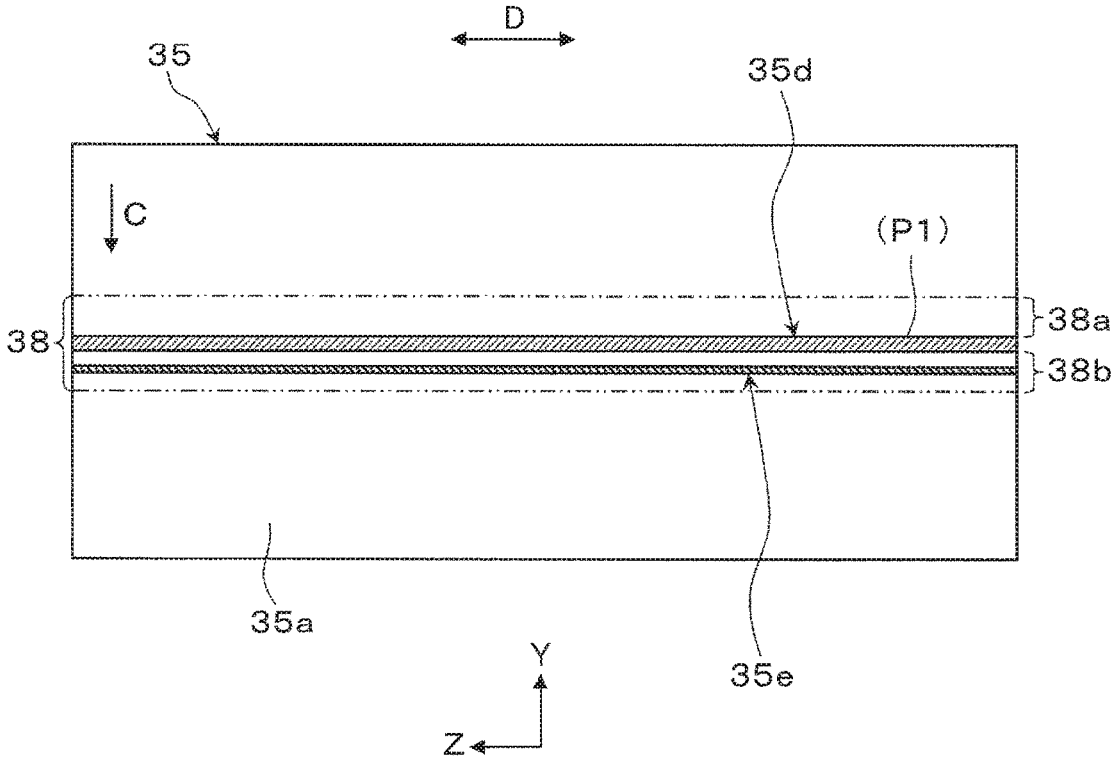
FIG. 6 conceptually illustrates the structure of a portion where the first cleaning plate and the second cleaning plate are in contact in the cleaner illustrated in FIG. 3.

As illustrated in, for example, FIGS. 3, 5, and 6, the first cleaning plate 62 performs cleaning through contact of a free end 62*a* thereof not being secured but in a free state with the outer circumferential surface of the second transfer roller 35 such that the outer circumferential surface of the second transfer roller 35 is elastically deformed and the free end 62*a* extends substantially in the rotational axis direction D of the second transfer roller 35. In FIG. 6, reference numeral 35*d* denotes a portion of an outer circumferential surface 35*a* of the second transfer roller 35 in contact with the free end 62*a* of the first cleaning plate 62.

The first cleaning plate 62 according to the first exemplary embodiment is disposed such that the free end 62*a* (corner portion) of the first cleaning plate 62 is in contact with the portion of the second transfer roller 35 that is a facing portion substantially completely opposite to (a position spaced in the rotational direction by a central angle of 180° from) a portion of the second transfer roller 35 in contact with the support roller 32*b* serving as the backup roller with the intermediate transfer belt 31 interposed therebetween. Furthermore, a securing end (end portion opposite to the free end 62*a*) of the first cleaning plate 62 being an end portion on the securing side is secured to the support member 66 by a required attachment width J1 (see FIG. 3). The length of a portion of the first cleaning plate 62 other than a portion having the attachment width J1 is a free length L1.

As the first cleaning plate 62, a member formed of a material the stiffness of which has higher physical properties than the physical properties of the outer circumferential surface portion of the second transfer roller 35 is used. According to the first exemplary embodiment, as the first cleaning plate 62, a plate-shaped member that is formed of an elastically deformable material such as, for example, rubber or synthetic resin and has a substantially rectangular shape and a required thickness is used. Stiffness is correlated in accordance with at least one of indices such as, for example, Young's modulus, hardness, tensile strength, and 100% modulus (tensile stress). The stiffness of the second transfer roller 35 refers to, in particular, the stiffness of the elastic layer 352.

The first cleaning plate 62 is provided so that a contact load of the first cleaning plate 62 on the outer circumferential surface 35*a* of the second transfer roller 35 is, for example, 2 to 4 gf/mm (≈1960 to 3920 mN/mm), and preferably 2.5 to 3.5 gf/mm (≈2450 to 3430 mN/mm). Furthermore, the first cleaning plate 62 is provided so that a pressing depth of the free end 62*a* of the first cleaning plate 62 into the outer circumferential surface 35*a* of the second transfer roller 35 when the first cleaning plate 62 is in contact with the outer circumferential surface 35*a* of the second transfer roller 35 at the above-described contact load is about 1 to 2 mm. Furthermore, the first cleaning plate 62 is provided so that a contact angle of the first cleaning plate 62 relative to the outer circumferential surface 35*a* of the second transfer roller 35 is, for example, as follows: an attachment angle relative to the second transfer roller 35 is 20 to 30°, and, when the first cleaning plate 62 is in contact with the second transfer roller 35, a bending angle (working angle) is 5 to 15°.

Among these, the contact load is obtained, for example, as follows. That is, the relationship between the contact load of the first cleaning plate 62 and the pressing depth of the first cleaning plate 62 into the outer circumferential surface 35*a* of the second transfer roller 35 is found in advance by measurement with a load measuring device. Next, the securing end of the first cleaning plate 62 is attached to an attachment portion at a required attachment angle, the free end of the first cleaning plate 62 is brought into contact with the outer circumferential surface 35*a* of the second transfer roller 35, and the actual pressing depth at this time is measured by a laser displacement gage. The measured pressing depth values are checked with data indicating the relationship between the contact load and the pressing depth having been prepared in advance. In this way, load information is obtained. This load information is recognized as the contact load to be obtained.

The pressing depth is a length by which the free end 62*a* of the first cleaning plate 62 is moved into an inner circumstantial side of the second transfer roller 35 relative to the outer circumferential surface 35*a* of the second transfer roller 35 in a state in which the free end 62*a* is assumed not to be in contact with the outer circumferential surface 35*a* at all (flat plate-shaped state without elastic deformation).

As illustrated in, for example, FIGS. 3 to 6, the second cleaning plate 63 is a plate-shaped member that cleans the second transfer roller 35 with its free end 63*a* in contact with a portion 38 of the outer circumferential surface 35*a* of the second transfer roller 35 (more exactly, an elastically deformed portion 38*b* on the downstream side as will be described later). The portion 38 is downstream of the position in contact with the free end 62*a* of the first cleaning plate 62 in a rotational direction C of the second transfer roller 35. At the portion 38, the second transfer roller 35 is elastically deformed so that the surface curvature is reduced compared to portions other than the portion 38 due to the contact with the free end 62*a* of the first cleaning plate 62. The free end 63*a* of the second cleaning plate 63 is also in contact with the second transfer roller 35 substantially in the rotational axis direction D of the second transfer roller 35. In FIG. 6, reference numeral 35*e* denotes a portion of the outer circumferential surface 35*a* of the second transfer roller 35 in contact with the free end 63*a* of the second cleaning plate 63.

In the second transfer roller 35, as illustrated in, for example, FIGS. 5 and 6, the portion 38 actually elastically deformed due to contact with the first cleaning plate 62 includes an upstream deformed portion 38*a* and the downstream deformed portion 38*b* respectively existing in a rearward portion and a forward portion which are, in the rotational direction C of the second transfer roller 35, upstream and downstream of a contact start position P1 which is interposed between the deformed portion 38*a* and the deformed portion 38*b*. The contact with the free end 62*a* of the first cleaning plate 62 starts at the contact start position P1. The free end 63*a* of the second cleaning plate 63 is in contact with a region in the downstream deformed portion 38*b*.

Furthermore, the state of the surface of the elastically deformed portion 38 is slightly flatter than the curved surface of the cylindrical side surface. Accordingly, the surface curvature of the portion 38 is reduced compared to surface curvatures of portions other than the portion 38 (portions of the outer circumferential surface 35*a* not elastically deformed). The state of the surface of a boundary portion between the elastically deformed portion 38 and another portion is a curved surface nearly an angular shape in section, and accordingly, the surface curvature of the boundary portion is largest in the outer circumferential surface 35*a* of the second transfer roller 35.

Figure 4:
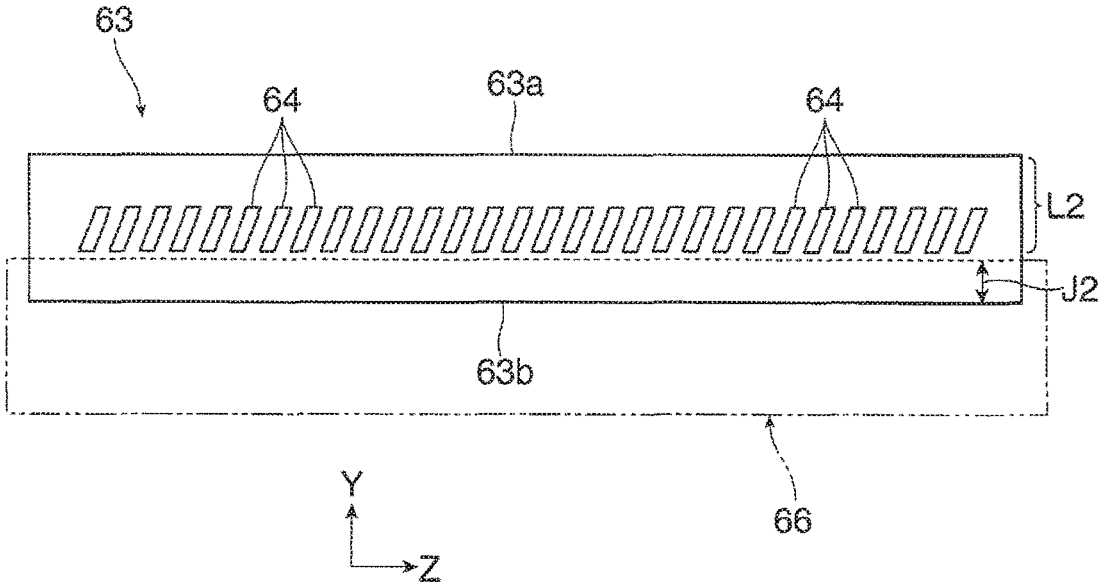
FIG. 4 illustrates the structure of a second cleaning plate of the cleaner illustrated in FIG. 3.

A securing end 63*b* of the second cleaning plate 63 is also secured to the support member 66 by a required attachment width J2 (see FIG. 4). Also, the length of a portion of the second cleaning plate 63 other than a portion having the attachment width J2 is a free length L2.

As the second cleaning plate 63, a member formed of a material the stiffness of which has higher physical properties than the physical properties of the first cleaning plate 62 is used. According to the first exemplary embodiment, as the second cleaning plate 63, a substantially rectangular plate-shaped member which is formed of a material having a higher stiffness than the stiffness of the first cleaning plate 62 (such as, for example, rubber or synthetic resin) is used. The second cleaning plate 63 is a thin member (thin plate) having a smaller thickness (plate thickness) than the thickness of the first cleaning plate 62.

Furthermore, the second cleaning plate 63 is provided so that a contact load of the second cleaning plate 63 on the outer circumferential surface 35*a* of the second transfer roller 35 is, for example, 0.5 to 2 gf/mm (≈4.9 to 19.6 mN/mm). This contact load of the second cleaning plate 63 is set to be smaller than the contact load of the first cleaning plate 62. Furthermore, the second cleaning plate 63 is provided so that a pressing depth of the free end 63*a* of the second cleaning plate 63 into the outer circumferential surface 35*a* of the second transfer roller 35 when the second cleaning plate 63 is in contact with the outer circumferential surface 35*a* of the second transfer roller 35 with the above-described contact load is about 0.3 to 0.7 mm.

A common support member 66 supports the first cleaning plate 62 and the second cleaning plate 63 with the securing end and the securing end 63*b* of the first cleaning plate 62 and the second cleaning plate 63 attached thereto. According to the first exemplary embodiment, a metal sheet formed by bending a rectangular metal sheet having a required thickness into an L shape in section is used as the support member 66. The securing end of the first cleaning plate 62 and the securing end 63*b* of the second cleaning plate 63 are attached by securing the portions having the attachment widths J1 and J2 of the first cleaning plate 62 and the second cleaning plate 63 to respective side surfaces 66*a* and 66*b* of a rise portion of the support member 66 having an L shape in section in a state in which the portions having the attachment widths J1 and J2 are disposed on the respective sides and kept in contact with the respective side surfaces 66*a* and 66*b*.

Furthermore, the support member 66 is secured to the housing 61 at a required position and in a required state so that the free end 62*a* and the free end 63*a* of the first cleaning plate 62 and the second cleaning plate 63 attached to the common support member 66 are in contact with the outer circumferential surface 35*a* of the second transfer roller 35 at the above-described positions and in the above-described states. According to the first exemplary embodiment, both ends of the support member 66 in the longitudinal direction are attached to and secured to attachment portions provided in advance on side surface portions of the housing 61.

Figure 7:
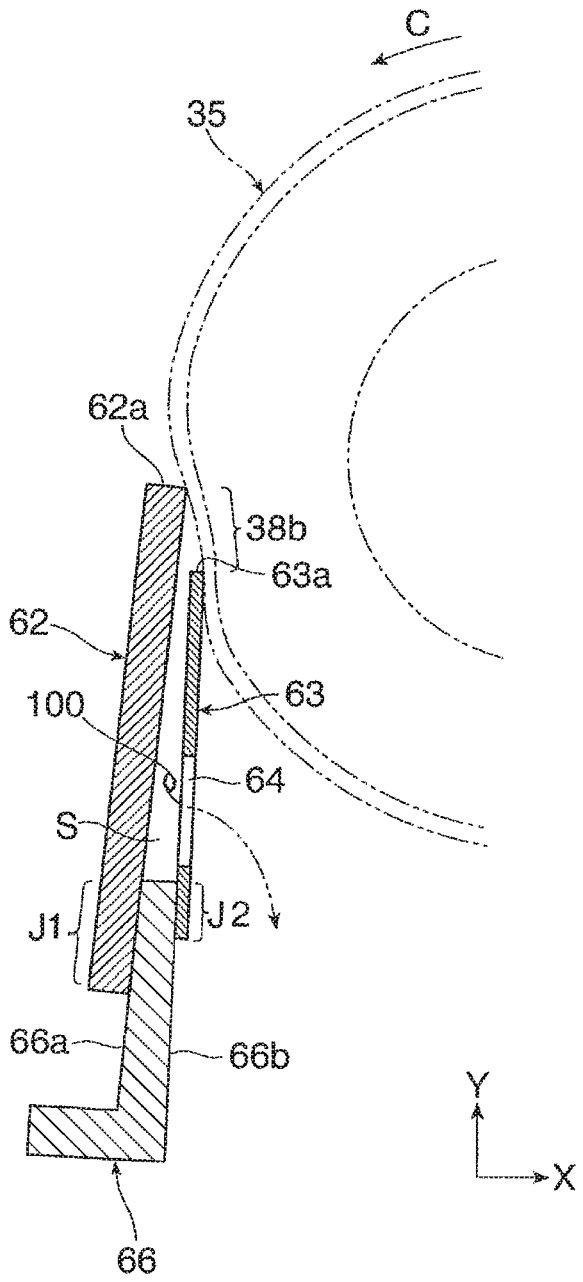
FIG. 7 is a partially sectional view conceptually illustrating a state of cleaning operation of the cleaner illustrated in FIG. 3.

Furthermore, as illustrated in FIGS. 3 and 7, the first cleaning plate 62 and the second cleaning plate 63 are attached to the common support member 66 with the gap S existing therebetween in the cleaner 6. Accordingly, toner escaping being caught by the first cleaning plate 62 and matter removed by the second cleaning plate 63 may drop into and be accumulated in the gap S in the cleaner 6. When the accumulation increases, the toner and the removed matter may overflow through a nip between the free end 63*a* of the second cleaning plate 63 and the outer circumferential surface 35*a* of the second transfer roller 35.

Accordingly, as illustrated in, for example, FIGS. 3 and 4, the second cleaning plate 63 has through holes 64 communicating with the gap S in this cleaner 6.

As illustrated in, for example, FIG. 4, the through holes (a through hole group) 64 are provided as plural hole shapes serving as units equally spaced from one another in the longitudinal direction of the second cleaning plate 63 (rotational axis direction D of the second transfer roller 35) according to the first exemplary embodiment. Furthermore, these through holes 64 are provided closer to a portion having the attachment width J2 in a portion corresponding to the free length L2 of the second cleaning plate 63. Furthermore, as illustrated in FIG. 4, as the hole shapes serving as the units, each of the through holes 64 is a thin parallelogram elongated in the vertical direction (direction along the coordinate axis Y) and inclined rightward. The conditions of the through holes 64 including the number and the shape may be arbitrarily determined as long as the cleaning performance of the second cleaning plate 63 is not reduced and removed matter and the like are able to pass through and be discharged in an efficient manner to the outside from the gap S through the second cleaning plate 63.

Operation of the Cleaner for the Second Transfer Roller

As has been described, the free end 62*a* of the first cleaning plate 62 and the free end 63*a* of the second cleaning plate 63 of the cleaner 6 are continuously in contact with the outer circumferential surface 35*a* of the second transfer roller 35 being rotated in the arrow C (for example, FIGS. 3 and 5) direction.

When, due to an operation such as an image forming operation, undesired matter such as toner adheres to the outer circumferential surface 35*a* of the second transfer roller 35 through the intermediate transfer belt 31, this cleaner 6 performs cleaning as follows.

That is, first, the cleaner 6 removes the undesired matter so as to scrape off the undesired matter by using the free end 62*a* of the first cleaning plate 62 which is in contact with earlier a portion of the outer circumferential surface 35*a* on the upstream side in the rotational direction C of the second transfer roller 35.

In so doing, a large part of the matter removed by the free end 62*a* of the first cleaning plate 62 is toner. In the housing 61, the removed matter such as toner drops in a free fall due to gravity and is received in the collection space 61*b*. At this time, in some cases, the undesired matter is not necessarily entirely removed by the free end 62*a* of the first cleaning plate 62. A large part of the not removed undesired matter is the external additive externally added to the toner. Other than the external additive, the not removed matter includes the toner and components of the toner.

Next, the cleaner 6 removes the undesired matter not having been removed by the free end 62*a* of the first cleaning plate 62 so as to scrape off the undesired matter by using the free end 63*a* of the second cleaning plate 63 which is in contact with a portion of the outer circumferential surface 35*a* downstream of the contact position of the free end 62*a* of the first cleaning plate 62 in the rotational direction C of the second transfer roller 35.

In so doing, the free end 63*a* of the second cleaning plate 63 is in contact with the elastically deformed portion 38*b* on the downstream side. The elastically deformed portion 38*b* is elastically deformed so that the surface curvature is reduced compared to the other portions of the outer circumferential surface 35*a* of the second transfer roller 35 due to the contact of the free end 62*a* of the first cleaning plate 62 with the outer circumferential surface 35*a*. Accordingly, the second cleaning plate 63 is unlikely to be affected by small changes in the outer circumferential surface 35*a* such as shake and undulations compared to the portions of the outer circumferential surface 35*a* that are not elastically deformed. This may allow the second cleaning plate 63 to be stably in contact with the elastically deformed portion 38*b* on the downstream side. Thus, the capability of the free end 63*a* of the second cleaning plate 63 to remove the undesired matter may be improved compared to the capability of the free end 62*a* of the first cleaning plate 62.

As a result, the free end 63*a* of the second cleaning plate 63 may reliably remove the undesired matter not having been removed by the free end 62*a* of the first cleaning plate 62. In this case, even when the undesired matter includes the film-shaped substances having been described, the film-shaped substances may be reliably removed compared to the case where a cleaner that causes only the free end 62*a* of the first cleaning plate 62 to be in contact is used. The removed matter including, for example, the film-shaped substances drops in a free fall due to gravity and is received in the gap S surrounded by three elements, that is, the first cleaning plate 62, the second cleaning plate 63, and the support member 66.

Furthermore, the stiffness of the first cleaning plate 62 of the cleaner 6 is higher than the stiffness of the second transfer roller 35. This may facilitate formation of the elastically deformed portion 38 having a reduced surface curvature in the second transfer roller 35 by the first cleaning plate 62 due to the contact of the free end 62*a* of the first cleaning plate 62 with the second transfer roller 35. Furthermore, the stiffness of the second cleaning plate 63 is higher than the stiffness of the first cleaning plate 62 in the cleaner 6. Accordingly, a grinding effect produced with the free end 63*a* of the second cleaning plate 63 on the outer circumferential surface 35*a* of the second transfer roller 35 is higher than that with the free end 62*a* of the first cleaning plate 62. Thus, with the cleaner 6, the undesired matter such as the film-shaped substances may be reliably removed.

Furthermore, the contact load of the second cleaning plate 63 on the outer circumferential surface 35*a* of the second transfer roller 35 is set to be smaller than the contact load of the first cleaning plate 62 in the cleaner 6. Accordingly, the first cleaning plate 62 is in contact with the outer circumferential surface 35*a* of the second transfer roller 35 at a comparatively large contact load. This may facilitate carrying out of the function of reliably forming the elastically deformed portion 38. Furthermore, the second cleaning plate 63 is in contact with the outer circumferential surface 35*a* of the second transfer roller 35 at a comparatively small contact load. This may facilitate carrying out of the function of removing the film-shaped substances while being in contact with the outer circumferential surface 35*a* without applying load to the outer circumferential surface 35*a*.

Furthermore, with the cleaner 6, the removed matter such as the film-shaped substances removed by the free end 63*a* of the second cleaning plate 63 drops and is received in the gap S as has been described. However, part of removed matter 100 is, as exemplified in FIG. 7, discharged from the gap S through the through holes 64 provided in the second cleaning plate 63. The removed matter 100 having been discharged through the through holes 64 drops and is received in the collection space 61*b* of the housing 61 at last. Thus, after the removed matter such as the film-shaped substances removed by the free end 63*a* of the second cleaning plate 63 has been accumulated in the gap S, the removed matter is able to be prevented from passing through the nip between the free end 63*a* of the second cleaning plate 63 and the outer circumferential surface 35*a* of the second transfer roller 35 so as to be returned to the outer circumferential surface 35*a*.

In addition to the above description, as the second transfer roller 35 of the image forming apparatus 1, a roller having a structure in which the surface layer 353 formed of synthetic resin is provided on the elastic layer 352 of the second transfer roller 35 is used. Accordingly, compared to the case of a second transfer roller in which the surface layer 353 is not provided and the elastic layer 352 serves as the surface layer, the outer circumferential surface 35*a* of the second transfer roller 35 is more smoothed with reduced undulations and reduced surface roughness. Thus, even when the film-shaped substances are formed on the outer circumferential surface 35*a* of the second transfer roller 35, the film-shaped substances may be reliably removed by the second cleaning plate 63.

Testing

Next, testing of the performance of the cleaner 6 is described.

In the testing, the cleaner 6 having the following structure is used for the second transfer roller 35 having the following structure.

As the second transfer roller 35, a roller having a comparatively small diameter (outer diameter: ϕ18 mm; Asker C hardness: 35 degrees) is used. This roller is formed by stacking the elastic layer 352 and the surface layer 353 in this order on the outer circumferential surface of the metal roller base body 351. Here, the elastic layer 352 having a thickness of 4.5 mm is formed of a material such as urethane foam in which a conductant agent is dispersed, and the surface layer 353 having a thickness of about 50 μm is formed of polyimide. This second transfer roller 35 is mounted in a DocuCenter-V 7750 multi-function machine manufactured by Fuji Xerox Co., Ltd. Thus, a testing machine is obtained. For this testing, plural testing machines are prepared.

As the first cleaning plate 62 of the cleaner 6, a rectangular plate-shaped member (Young's modulus: 8 MPa) is used. This first cleaning plate 62 is formed of polyurethane rubber. The size of this first cleaning plate 62 is 1.9 mm in thickness, 325 mm in length of the long side, and 13 mm in length of the short side. The first cleaning plate 62 is provided so as to be in contact with the outer circumferential surface 35*a* of the second transfer roller 35 so that the contact load of the free end 62*a* on the outer circumferential surface 35*a* of the second transfer roller 35 is about 30 mN/mm and the pressing depth of the free end 62*a* into the outer circumferential surface 35*a* of the second transfer roller 35 is about 1 mm. At this time, the attachment width J1 for attachment to the support member 66 is 5 mm, and the free length L1 of the first cleaning plate 62 is 8 mm.

As the second cleaning plate 63 of the cleaner 6, a rectangular plate-shaped member (Young's modulus: 200 GPa) is used. This second cleaning plate 63 is formed of stainless steel (SUS304). The size of this second cleaning plate 63 is 2 mm in thickness, 325 mm in length of the long side, and 15 mm in length of the short side. The second cleaning plate 63 is provided so as to be in contact with the outer circumferential surface 35*a* of the second transfer roller 35 so that the contact load of the free end 63*a* of the second cleaning plate 63 on the outer circumferential surface 35*a* of the second transfer roller 35 is about 13 mN/mm. At this time, the attachment width J2 for attachment to the support member 66 is 5 mm, and the free length L2 of the second cleaning plate 63 is 10 mm. The pressing depth of the second cleaning plate 63 is set to three different values, that is, 0.3 mm, 0.5 mm, and 0.7 mm for an example at last (FIG. 9). Furthermore, plural parallelogram unit shapes having a width (short side) of 2 mm and a height (long side) of 4 mm and inclined rightward at the inclination angle of 60 degrees are formed in the second cleaning plate 63 so as to be spaced from one another by 2 mm (see FIG. 4).

As the support member 66, a metal sheet having a thickness of 2 mm and a L-shape in section formed of galvanized sheet iron is used. The portions having the attachment width J1 and the attachment width J2 of the first cleaning plate 62 and the second cleaning plate 63 are secured to the support member 66 by bonding with a contact substance such as a hot melt to the side surfaces 66*a* and 66*b*, respectively, of the rise portion of the support member 66.

The cleaner 6 having the above-described structure is mounted as the cleaner for the second transfer roller 35 of the above-described testing machine.

First, in the testing machine of this example, the amount of elastic deformation and the width of the deformed portion of the outer circumferential surface 35*a* of the second transfer roller 35 when the pressing depth of the first cleaning plate 62 of the cleaner 6 is varied are checked. The results are illustrated in FIG. 8.

The amount of elastic deformation and the width of the deformed portion at this time are obtained through measurement in which a state of a portion of the outer circumferential surface 35*a* of the second transfer roller 35 elastically deformed due to contact with the first cleaning plate 62 is observed with a digital HD microscope (VH-700) manufactured by KEYENCE Corporation, and the observed state is subjected to image analysis.

Figure 8:
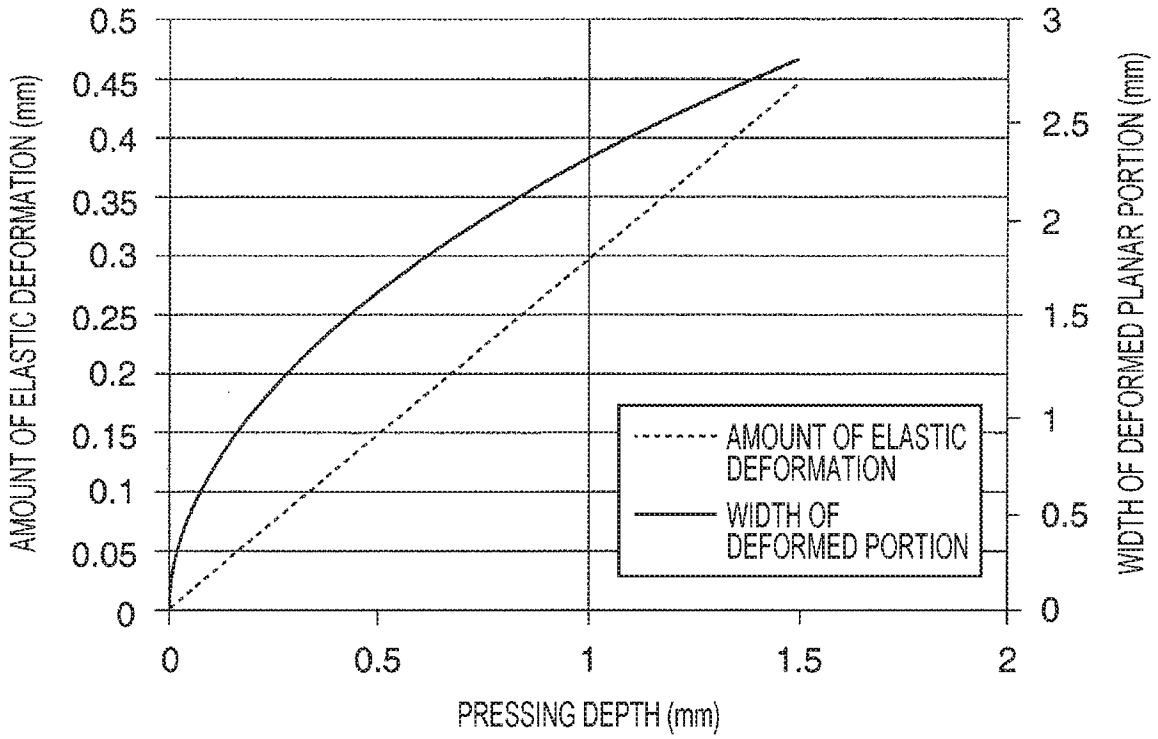
FIG. 8 is a graph illustrating the relationships of the pressing depth of the first cleaning plate relative to the amount of elastic deformation and the width of an elastically deformed portion in the cleaner used as an example of testing.

According to the results illustrated in FIG. 8, when the pressing depth of the first cleaning plate 62 is 1 mm, due to contact with the free end 62*a* of the first cleaning plate 62, the outer circumferential surface 35*a* of the second transfer roller 35 having a comparatively small diameter is elastically deformed so that the surface curvature is reduced compared to the other portions of the outer circumferential surface 35*a* (see FIG. 5). It is found that, in this case, the maximum amount of deformation of the elastically deformed portion 38 is 0.3 mm, and the width of the deformed portion 38 is 2.3 mm in both the forward and rearward in the rotational direction C from the contact start position P1 of the free end 62*a* of the first cleaning plate 62.

With reference to these results, the pressing depth of the first cleaning plate 62 is set to 1 mm in the example. Furthermore, the contact position where the second cleaning plate 63 is in contact with the outer circumferential surface 35*a* of the second transfer roller 35 is set at a position downstream of the contact start position P1 of the free end 62*a* of the first cleaning plate 62 by about 1.5 mm in the rotational direction C (FIG. 9).

In this testing, the cleaner 6 of the example is prepared such that, as illustrated in FIG. 9, the contact position of the free end 63*a* of the second cleaning plate 63 on the downstream side is about 1.5 mm from the contact start position P1 of the free end 62*a* of the first cleaning plate 62. Also in this testing, three of the cleaner 6 are prepared so that, as illustrated in FIG. 9, three values (0.3 mm, 0.5 mm, and 0.7 mm) of the pressing depth of the free end 63*a* of the second cleaning plate 63 are set.

The cleaners 6 of the example are mounted in the above-described testing machines, and endurance testing is performed with the recording sheets 9 corresponding to 100,000 sheets by using these testing machines.

The endurance testing is performed under a high-temperature high-humidity environment in which the temperature is 28° C. and the humidity is 85% RH. In the endurance testing, a test image is continuously formed on the recording sheets 9 corresponding to 100,000 sheets. After that, whether or not the film-shaped substances are produced (formed) on the outer circumferential surface 35*a* of the second transfer roller 35 and whether or not the free end 63*a* of the second cleaning plate 63 is scratched are checked by visual observation. The test image is a frame image for the A4 size having a width of 4 mm and formed by superposing toner images (each have an image density of 80%) of the above-described four colors (Y, M, C, and K). In order to form a borderless image, this test image is formed on A4 recording sheets 9 such that edge portions of the frame image lie off by 2 mm from edge portions of the recording sheets 9 at four sides (borderless image).

The results of this testing are illustrated in FIG. 9.

The second transfer roller 35 is rotated at a speed of 300 mm/second by being in contact with the intermediate transfer belt 31 rotated in the arrow B direction. As the recording sheets 9, A4 sheets (Ncolor209 manufactured by Fuji Xerox Co., Ltd) are used. The recording sheets 9 are fed with the short side thereof on the leading side. As the two-component developer 8, a developer formed of magnetic carrier and non-magnetic toner having an average particle size of 3 to 10 μm is used. This non-magnetic toner is formed of styrene acrylic resin or polyester resin with a molecular weight of 5000 to 100,000. The external additive externally added to this non-magnetic toner includes an inorganic particulate powder of, for example, silica, titania, alumina, cerium oxide, or strontium titanate or an organic particulate powder of, for example, higher alcohol, zinc stearate, acrylic resin, or fluororesin. The average particle size of the external additive is 10 nm to 10 μm.

Figure 13:
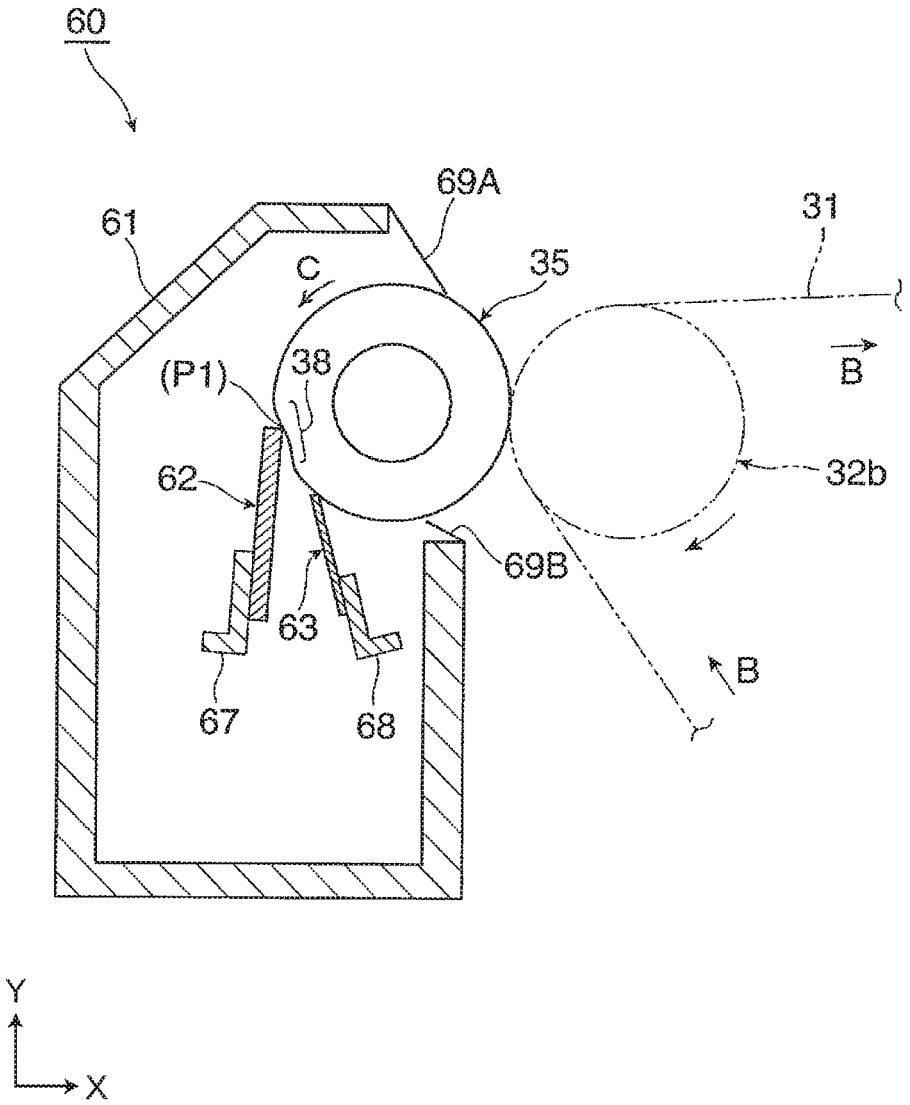
FIG. 13 is a partially sectional view conceptually illustrating the structure of the cleaner used as the comparative example of the testing.

For comparison, a cleaner 60 of a comparative example is prepared, and the above-described endurance testing is similarly performed on the cleaner 60. The cleaner 60 is made by changing the cleaner 6 of the example so that, as illustrated in FIG. 13, the contact position where the second cleaning plate 63 is in contact with the outer circumferential surface 35*a* of the second transfer roller 35 is set downstream of the contact start position P1 of the free end 62*a* of the first cleaning plate 62 by about 10 mm in the rotational direction C (FIG. 9).

The results of the testing of the comparative example are also illustrated in FIG. 9.

From the results illustrated in FIG. 9, it is understood that, with the example, even when the pressing depth of the second cleaning plate 63 varies, neither the film-shaped substances are produced nor the free end 63*a* of the second cleaning plate 63 is scratched.

Accordingly, it is understandable that, with the cleaner 6 of the example, the external additive or the like of toner that causes production of the film-shaped substances which remain adhering to a portion of the outer circumferential surface 35*a* of the second transfer roller 35 past the first cleaning plate 62 is removed by the second cleaning plate 63. Furthermore, it is understood that, with the cleaner 6 of the example, the free end 63*a* of the second cleaning plate 63 may have good durability and may be unlikely to be scratched. From the above-described results, the effect of removing the film-shaped substances produced by the second cleaning plate 63 may be likely to be obtained for a long time.

In contrast, it is understood that, with the cleaner 60 of the comparative example, the film-shaped substances tend to be produced independently of variation of the pressing depth of the second cleaning plate 63. Furthermore, with the comparative example, as the pressing depth of the second cleaning plate 63 increases, the free end 63*a* of the second cleaning plate 63 tends to be more likely to be scratched.

It is understandable that, particularly with the cleaner 60 of the comparative example, when the pressing depth of the second cleaning plate 63 is increased to, for example, 0.7 mm, although the production of the film-shaped substances tends to be able to be reduced, the production of the film-shaped substances is unable to be prevented. Furthermore, it is understandable that, with the cleaner 60 of the comparative example, when the pressing depth of the second cleaning plate 63 is increased to, for example, 0.7 mm, although the production of the film-shaped substances tends to be able to be suppressed, the free end 63*a* of the second cleaning plate 63 is certainly scratched.

Figure 10:
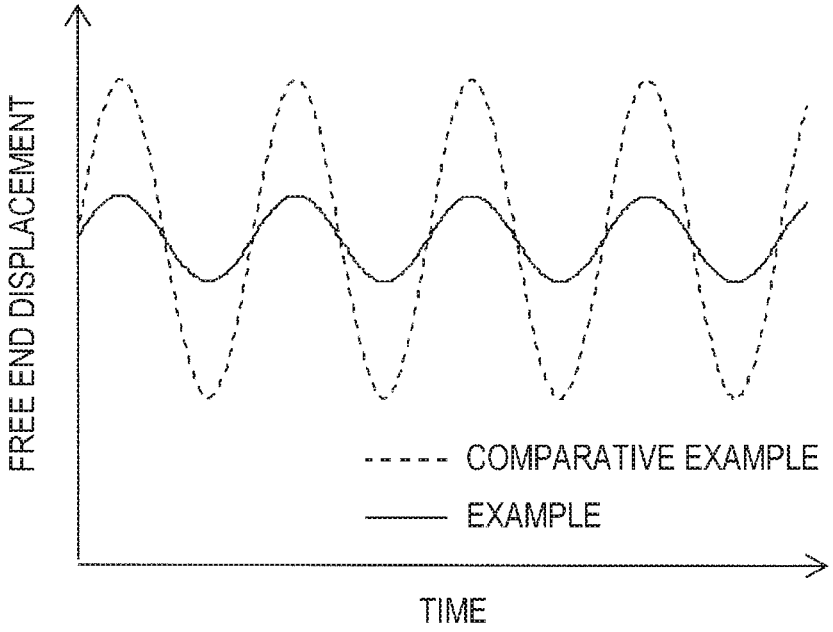
FIG. 10 is a graph conceptually illustrating the difference in displacement of a free end of the second cleaning plate between the cleaner of the example and a cleaner of a comparative example used in endurance testing.

Corresponding to the difference in contact position of the second cleaning plate 63 with the second transfer roller 35 between the cleaner 6 of the example and the cleaner 60 of the comparative example (FIG. 9), there tends to be the difference in displacement (amount of fluctuation) of the free end 63*a* of the second cleaning plate 63 between the cleaner 6 of the example and the cleaner 60 of the comparative example as conceptually illustrated in FIG. 10.

That is, when the second cleaning plate 63 is in contact with the second transfer roller 35 in the elastically deformed portion 38*b* on the downstream side in the elastically deformed portion of the second transfer roller 35 as is the case with the second cleaning plate 63 of the cleaner 6 of the example, the displacement of the free end 63*a* of the second cleaning plate 63 is suppressed compared to the case where the second cleaning plate 63 is in contact with the second transfer roller 35 at a position, instead of in the elastically deformed portion 38*b* on the downstream side in the elastically deformed portion of the second transfer roller 35, further to the downstream side in the rotational direction C than the elastically deformed portion 38*b* (in other words, a not elastically deformed portion) as is the case with the second cleaning plate 63 of the cleaner 60 of the comparative example.

Accordingly, with the cleaner 6 of the example, the free end 63*a* of the second cleaning plate 63 is stably in contact with the outer circumferential surface 35*a* of the second transfer roller 35. Thus, good cleaning performance may be likely to be ensured. It is noted that FIG. 10 exemplifies displacement on the assumption that the displacement periodically varies. Also in FIG. 10, a single period of a substantially sine curve indicated by a solid line representing a result of the example substantially corresponds to a single rotation of the second transfer roller 35.

Second Exemplary Embodiment

Figure 11:
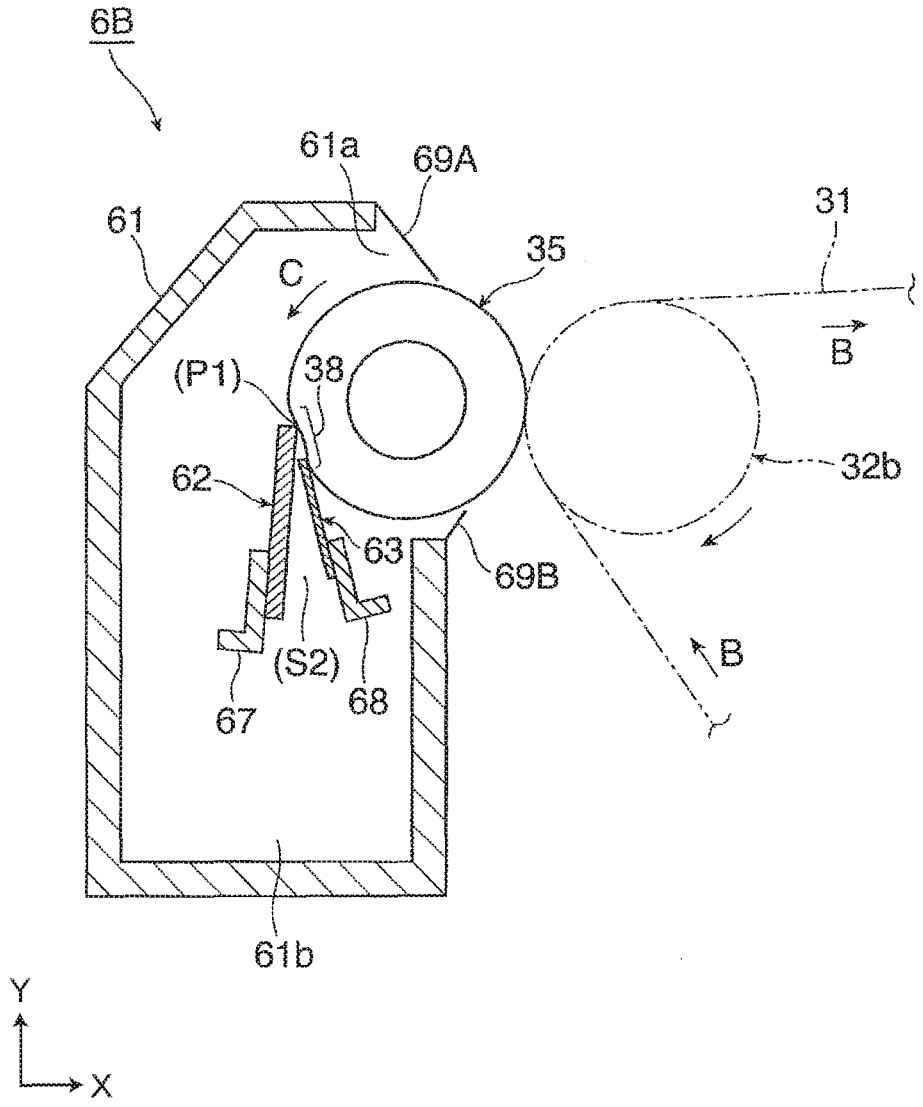
FIG. 11 is a partially sectional view conceptually illustrating the structure of a cleaner according to a second exemplary embodiment.

FIG. 11 illustrates a cleaner 6B according to a second exemplary embodiment.

The first cleaning plate 62 and the second cleaning plate 63 of the cleaner 6B are respectively attached to separate support members 67 and 68. Other than this, the cleaner 6B has the same structure as the structure of the cleaner 6 according to the first exemplary embodiment.

According to the second exemplary embodiment, a portion of the first cleaning plate 62 having an attachment width J1' is in contact with and secured to the first support member 67, and a portion of the second cleaning plate 63 having an attachment width J2' is in contact with and secured to the second support member 68. The first support member 67 and the second support member 68 are formed of respective metal sheets having substantially L shapes in section and made of the same material. Both end portions of each of the first support member 67 and the second support member 68 in the longitudinal direction are attached by being secured to attachment portions provided on side wall surfaces of the housing 61.

This cleaner 6B allows cleaning to be performed, and in particular, removal of the film-shaped substances to be performed substantially similarly to the cleaner 6 according to the first exemplary embodiment.

Furthermore, a continuous space S2 directly communicating with the collection space 61*b* of the housing 61 is formed between the first cleaning plate 62 and the second cleaning plate 63 in the cleaner 6B. Accordingly, the through holes 64 as in the second cleaning plate 63 according to the first exemplary embodiment are not necessary for the second cleaning plate 63 of the cleaner 6B.

In contrast, the number of support members and the space for providing the support members increase with the cleaner 6B compared to the case where the first cleaning plate 62 and the second cleaning plate 63 are attached to the common support member 66 as is the case with the cleaner 6 according to the first exemplary embodiment. Accordingly, the production cost of the cleaner 6B and the space for providing the cleaner 6B may tend to increase corresponding to the increase in the number of the support members.

Other Exemplary Embodiments

The cleaner 6 according to the first exemplary embodiment may include a second cleaning plate having through holes of different structures from through holes of the second cleaning plate 63 having the through holes 64 (see, for example, FIG. 4) instead of the second cleaning plate 63.

Figure 12A:
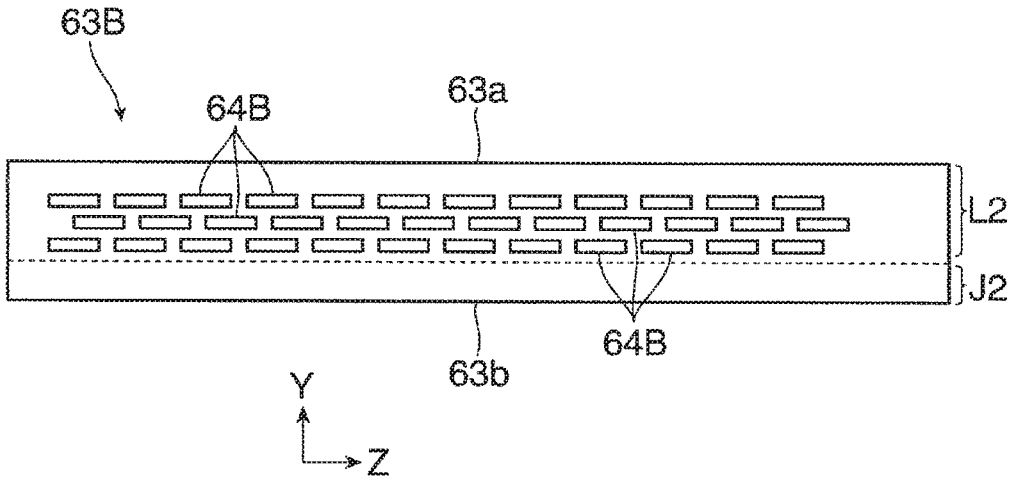
FIGS. 12A and 12B illustrate other examples of the structure of the second cleaning plate having through holes and provided in the cleaner, and out of FIGS. 12A and 12B.
Figure 12B:
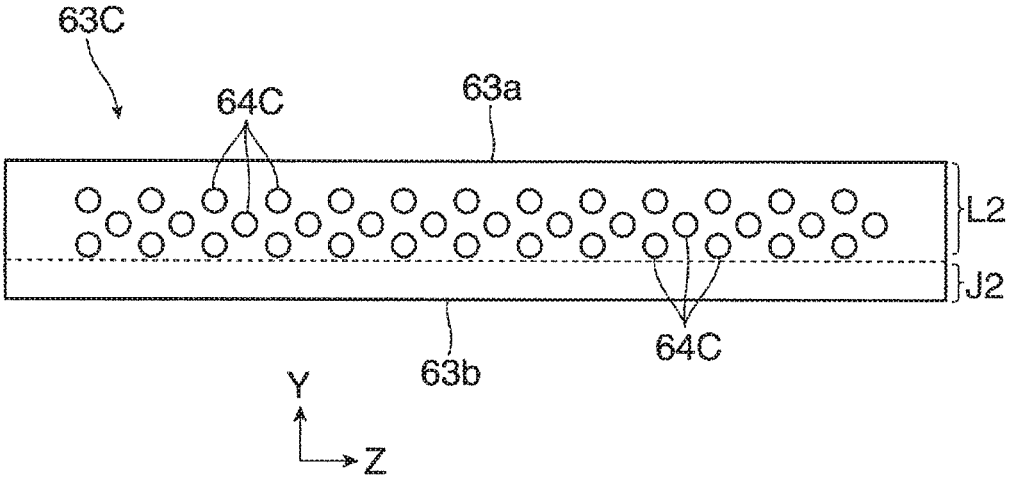

For example, as exemplified in FIG. 12A, a second cleaning plate 63B that has plural through holes (a through hole group) 64B may be used. The through holes 64B each have a laterally elongated rectangular unit shape and are arranged in three rows arranged in the vertical direction. The rows of the through holes 64B in which the through holes 64B are equally spaced from one another are laterally staggered. For example, as exemplified in FIG. 12B, a second cleaning plate 63C that has plural through holes (a through hole group) 64C may be used. The through holes 64C each have a circular unit shape and are arranged in three rows arranged in the vertical direction. The rows of the through holes 64C in which the through holes 64C are equally spaced from one another are laterally staggered.

Furthermore, the shape of the support member 66 of the cleaner 6 according to the first exemplary embodiment and the shapes of the support members 67 and 68 of the cleaner 6B according to the second exemplary embodiment may be changed.

Furthermore, as long as the image forming apparatus 1 at least includes an intermediate transfer rotating body represented by the intermediate transfer belt 31 and a cylindrical second transfer rotating body that includes the elastic layer 352 and is represented by the second transfer rotating body, and as long as the cleaner 6 or 6B exemplified according to the first exemplary embodiment, the second exemplary embodiment, or the like is able to be used for the image forming apparatus 1 as a cleaner in contact with an outer circumferential surface of the second transfer rotating body, the structure of the image forming apparatus 1 other these may be changed. For example, the number of the image forming devices 2 and the structure of, for example, the second transfer device may be changed.

In addition, the external additive of the toner used for the image forming apparatus 1 may be a material other than the materials exemplified for the above-described testing. For example, a material such as inorganic particulate powder of calcium carbonate, magnesium carbonate, or calcium phosphate or organic particulate powder of silica-containing resin or nitrogen-containing resin may be used. Furthermore, surface treatment using a surface treatment agent such as silane compound, silane coupler, or silicone oil may be performed on the surface of the external additive for hydrophobization.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments was/were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaner comprising:

a first cleaning plate that includes a first free end and that is configured to perform cleaning by causing the first free end to be in contact with an outer circumferential surface of a cylindrical second transfer rotating body that includes an elastic layer, so that the outer circumferential surface is elastically deformed; and a second cleaning plate that includes a second free end and that is configured to perform cleaning by causing the second free end to be in contact with a portion of the outer circumferential surface of the second transfer rotating body downstream of, in a rotational direction of the second transfer rotating body, a position where the first free end is in contact with the outer circumferential surface of the second transfer rotating body and where the outer circumferential surface of the second transfer rotating body is elastically deformed due to the contact of the outer circumferential surface of the second transfer rotating body with the first free end so as to have a smallest surface curvature in the outer circumferential surface of the second transfer rotating body, wherein the first cleaning plate has a higher stiffness than a stiffness of the second transfer rotating body, and the second cleaning plate has a higher stiffness than the stiffness of the first cleaning plate.

2. The cleaner according to claim 1, wherein a contact load of the second cleaning plate on the outer circumferential surface of the second transfer rotating body is set to be smaller than a contact load of the first cleaning plate on the outer circumferential surface of the second transfer rotating body.

3. The cleaner according to claim 2, wherein the first cleaning plate and the second cleaning plate include respective securing ends, and wherein both the securing ends of the first cleaning plate and the second cleaning plate are attached to a common support member.

4. The cleaner according to claim 3, wherein the second cleaning plate has a through hole communicating with a gap which is, when both the first cleaning plate and the second cleaning plate are attached to the common support member, formed between the first cleaning plate and the second cleaning plate.

5. The cleaner according to claim 1, wherein the first cleaning plate and the second cleaning plate include respective securing ends, and wherein both the securing ends of the first cleaning plate and the second cleaning plate are attached to a common support member.

6. The cleaner according to claim 5, wherein the second cleaning plate has a through hole communicating with a gap which is, when both the first cleaning plate and the second cleaning plate are attached to the common support member, formed between the first cleaning plate and the second cleaning plate.

7. An image forming apparatus comprising:

an intermediate transfer rotating body configured to hold a toner image and to be rotated so as to transport the toner image held by the intermediate transfer rotating body to a second transfer position where a recording medium is supplied;

a cylindrical second transfer rotating body that includes an elastic layer and that is in contact with the intermediate transfer rotating body at the second transfer position so as to be rotated; and the cleaner according to claim 1 that is in contact with the outer circumferential surface of the second transfer rotating body so as to perform cleaning.

8. A cleaner comprising:

a first cleaning plate that includes a first free end and that is configured to perform cleaning by causing the first free end to be in contact with an outer circumferential surface of a cylindrical second transfer rotating body that includes an elastic layer, so that the outer circumferential surface is elastically deformed; and a second cleaning plate that includes a second free end and that is configured to perform cleaning by causing the second free end to be in contact with a portion of the outer circumferential surface of the second transfer rotating body downstream of, in a rotational direction of the second transfer rotating body, a position where the first free end is in contact with the outer circumferential surface of the second transfer rotating body and where the outer circumferential surface of the second transfer rotating body is elastically deformed due to the contact of the outer circumferential surface of the second transfer rotating body with the first free end so as to have a smallest surface curvature in the outer circumferential surface of the second transfer rotating body, wherein a contact load of the second cleaning plate on the outer circumferential surface of the second transfer rotating body is set to be smaller than a contact load of the first cleaning plate on the outer circumferential surface of the second transfer rotating body.

* * * * *